United States Patent [19]

Autore

[11] Patent Number: 4,755,160

[45] Date of Patent: Jul. 5, 1988

[54] STUFFED TOY HAVING SPIRAL-SHAPED, FORM-RETAINING APPENDAGES AND METHOD OF FABRICATION THEREFOR

[75] Inventor: Gregory J. Autore, Torrance, Calif.

[73] Assignee: Mattel, Inc., Hawthorne, Calif.

[21] Appl. No.: 944,057

[22] Filed: Dec. 18, 1986

[51] Int. Cl.[4] ..... A63H 3/02

[52] U.S. Cl. ..... 446/369

[58] Field of Search ..... 446/369, 314, 368, 371

[56] References Cited

U.S. PATENT DOCUMENTS

| | | | |
|---|---|---|---|
| 240,096 | 4/1881 | Crane . | |
| 243,704 | 7/1881 | Howe . | |
| 788,221 | 4/1905 | Richardson . | |
| 958,387 | 5/1910 | Flynn | 446/371 |
| 1,435,267 | 11/1922 | Vathe . | |
| 1,848,257 | 3/1932 | Lewis | 446/314 |
| 2,830,402 | 4/1958 | Schleich . | |
| 2,853,831 | 9/1958 | Bischoff . | |
| 2,997,810 | 8/1961 | Bellas . | |
| 3,097,446 | 7/1963 | Packer . | |
| 3,448,539 | 7/1969 | Hartpence . | |
| 3,557,436 | 1/1971 | Hodes . | |
| 3,928,933 | 12/1975 | Iwamoto . | |
| 3,942,283 | 3/1976 | Rushton | 446/371 |
| 4,170,086 | 10/1979 | Hills | 446/372 |
| 4,226,046 | 10/1980 | Delhome | 446/385 |
| 4,296,567 | 10/1981 | Kamar | 446/369 |
| 4,505,687 | 3/1985 | Munro | 446/368 |
| 4,540,378 | 9/1985 | Cusimano | 446/369 |

*Primary Examiner*—Richard J. Johnson
*Assistant Examiner*—Michael Brown
*Attorney, Agent, or Firm*—Ronald M. Goldman; Melvin A. Klein; Daniel F. Sullivan

[57] ABSTRACT

A stuffed toy having spiral-shaped, form-retaining appendages. The appendages have spiral-shaped outer covers made out of a compliant material which are secured together at longitudinal seams extending along the length of the appendages. Fill material is stuffed inside the appendages formed by the covers. As a result, tapered spiral-shaped appendages are fabricated which return to their original shape after being manually deformed without the necessity of using elastic bands, metal devices, or resiliant material.

3 Claims, 4 Drawing Sheets

STUFFED TOY HAVING SPIRAL-SHAPED, FORM-RETAINING APPENDAGES AND METHOD OF FABRICATION THEREFOR

BACKGROUND OF THE INVENTION

The present invention relates generally to stuffed toys and to the methods of fabricating such toys, and more particularly to a stuffed toy having spiral-shaped form-retaining appendages and to the method of fabricating such a toy.

In the past, various types of form-retaining toys or figures have been fabricated. For example, U.S. Pat. Nos. 4,226,046; 3,928,933; 3,557,436; 3,448,539; 3,097,446; and 2,830,402 disclose toys or figurines using metal devices or resilient material to retain their shapes. Another shape-retaining toy is shown in U.S. Pat. No. 2,853,831. Resilient bracelets are disclosed in U.S. Pat. Nos. 788,221; 243,704; and 240,096. Stuffed or soft toys having appendages which can be manipulated or positioned are described in U.S. Pat. Nos. 4,540,378; 4,170,086; 3,942,283; 2,997,810; and 1,435,267. U.S. Pat. No. 4,296,567 describes a figure toy which can be suspended from a support using the weighted ends of the toy's flexible appendages. Finally, a form-retaining stuffed figurine is disclosed in U.S. Pat. No. 4,505,687 which utilizes a piece or band of elastic in a partially tensioned state to retain the figurine in a predetermined coiled shape.

None of the above patents discloses a toy having a spiral-shaped, stuffed appendage which may be manually deformed and then released, resulting in the appendage returning to its original shape without the necessity of using an elastic band, metal device, or resilient material. Elimination of elastic bands, metal devices and resilient material from stuffed form-retaining appendages would provide a more economical toy. Such spiral-shaped, form-retaining appendages allow a child to suspend a toy from a support, wrap the appendages around the toy, or play with the toy in a variety of different ways. Accordingly, there is a need in the toy manufacturing arts for a stuffed toy having spiral-shaped, form-retaining appendages and for a method of fabricating such a toy.

SUMMARY OF THE INVENTION

It is an object of this invention to provide a stuffed toy having spiral-shaped, form-retaining appendages which retain their shape without the necessity of using elastic bands, metal devices or resilient material.

It is another object of this invention to provide a stuffed toy having spiral-shaped, form-retaining appendages which have fabric outer covers secured together alone longitudinal seams.

It is still another object of this invention to provide a stuffed toy having spiral-shaped, form-retaining appendages which are stuffed harder with fill material near the ends of the tapered appendages.

It is still another object of this invention to provide a method of fabricating a stuffed toy having spiral-shaped, form-retaining appendages.

These and other objects and advantages are attained by a stuffed toy having spiral-shaped, form-retaining appendages. The appendages have spiral-shaped outer covers made out of a compliant material which are secured together at longitudinal seams extending along the length of the appendages. Fill material is stuffed inside the appendages formed by the covers. As a result, tapered spiral-shaped appendages are fabricated which return to their original shape after being manufally deformed without the necessity of using elastic bands, metal devices, or resiliant material.

The various features of the present invention will be best understood, together with further objects and advantages by reference to the following description of the preferred embodiments taken in connection with the accompanying drawings.

DESCRIPTION OF THE PREFERRED EMBODIMENT

The following specification taken in conjunction with the drawings set forth the preferred embodiments of the present invention in such a manner that any person skilled in the toy manufacturing arts can use the invention. The embodiments of the invention disclosed herein are the best modes contemplated by the inventor for carrying out his invention in a commercial environment, although it should be understood that various modifications can be accomplished within the parameters of the present invention.

Figure 1:
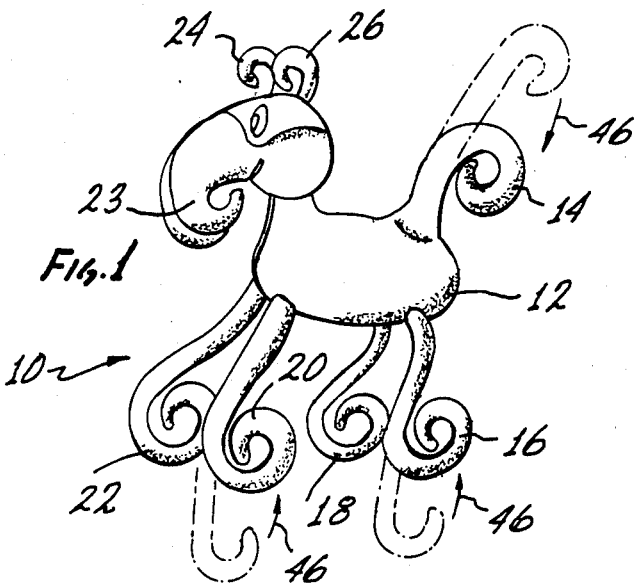
FIG. 1 is a perspective view of an embodiment of the stuffed toy of the presnt invention having spiral-shaped, form-retaining appendages.
Figure 6:
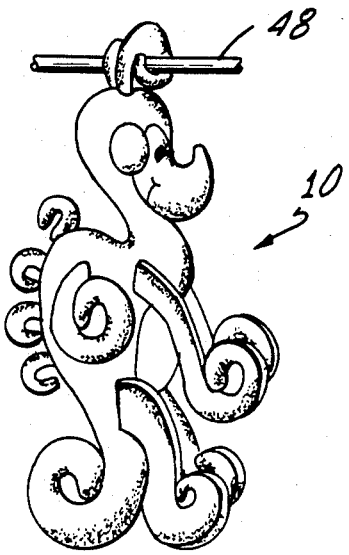
FIGS. 6 through 8 are perspective views showing how different embodiments of the stuffed toy of the present invention may be suspended from a support using the spiral-shaped, form-retaining appendages.
Figure 7:
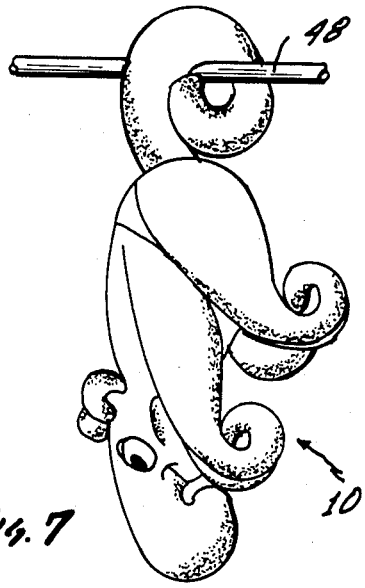
Figure 8:
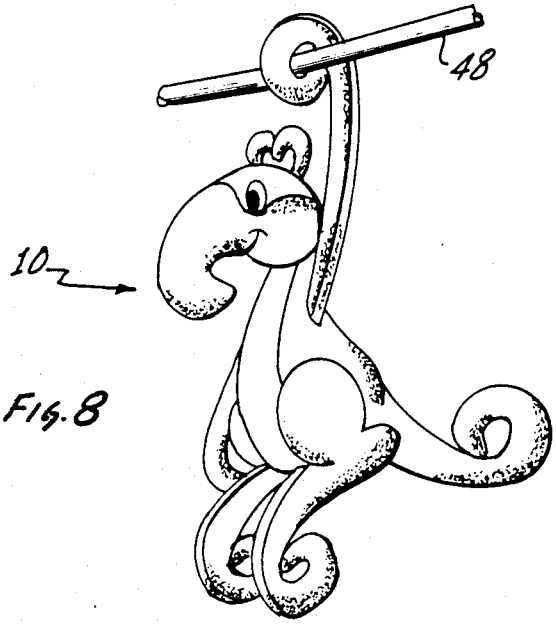

Referring now to the drawings and particularly to FIG. 1, a preferred embodiment of the stuffed toy 10 of the present invention is shown. The toy 10 has a body portion 12 with a plurality of spiral-shaped, form-retaining appendages 14 through 26 attached thereto. Any number of appendages may be attached to the toy 10. Also, the appendages may vary in shape or size. The shape or size of the body portion 12 may also vary and may represent any animate or inanimate form. For example, different embodiments of the toy 10 are shown in FIGS. 6 through 8.

Figure 4:
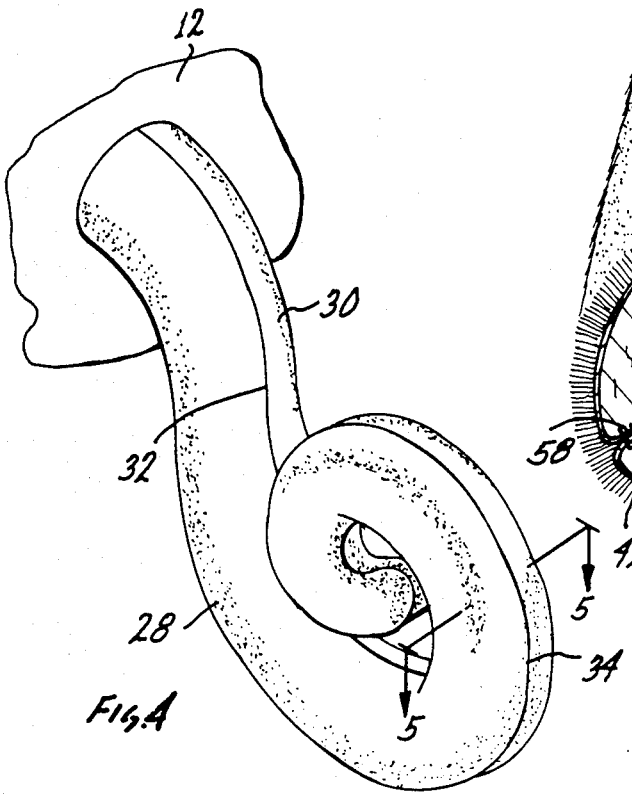
FIG. 4 is an enlarged perspective view of another embodiment of a spiral-shaped, form-retaining appendage.
Figure 9:
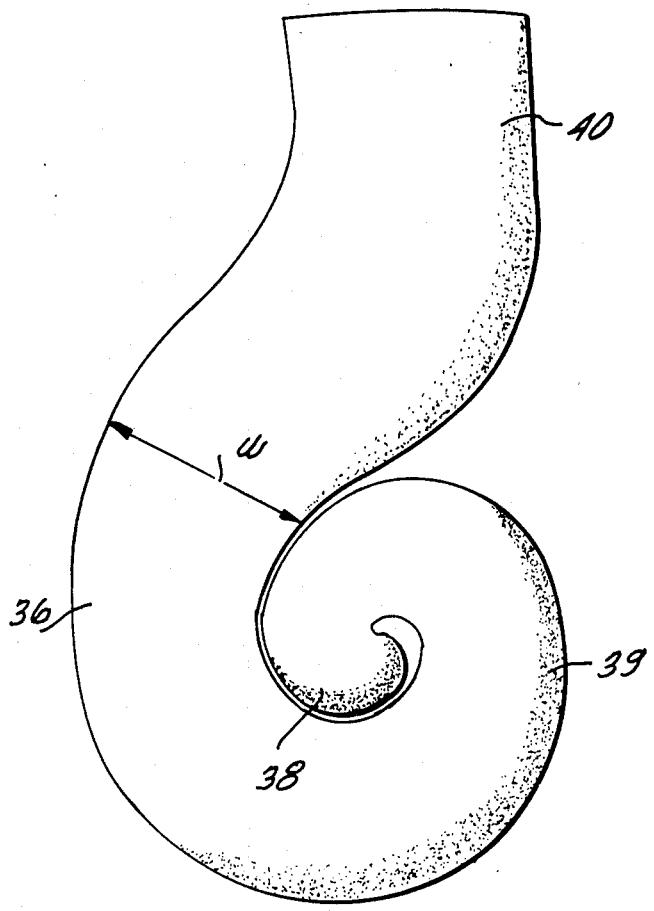
FIG. 9 is a plan view of an outer cover cut from a spiral-shaped pattern.

FIG. 4 shows one embodiment of the spiral-shaped, form retaining appendages. The shown appendage has outer covers 28 and 30 which are secured together along longitudinal inner and outer seams 32 and 34, respectively. Seams 32 and 34 are located along the curved inner and outer peripheries of the appendage, respectively, as shown in FIG. 4. Covers 28 and 30 may be made from any type of flexible or compliant material such as fabric, cloth, or the like. FIG. 9 shows one such outer cover which has been cut from a spiral-shaped pattern. Note that the cover has a width w which gradually diminishes in size or the appendage tapers from position 36 where the spiral shape starts to position 38 near the free end of the appendage. As best seen from FIGS. 4 and 9, the cross-section of the appendage decreases in size as the width w gradually diminishes along the spiral shpae, or the radius of the inner periphery of the appendage decreases as the width w diminishes. Upper portion 40 of the cover is used to attach the appendage to the body portion 12 of the toy 10.

Figure 3:
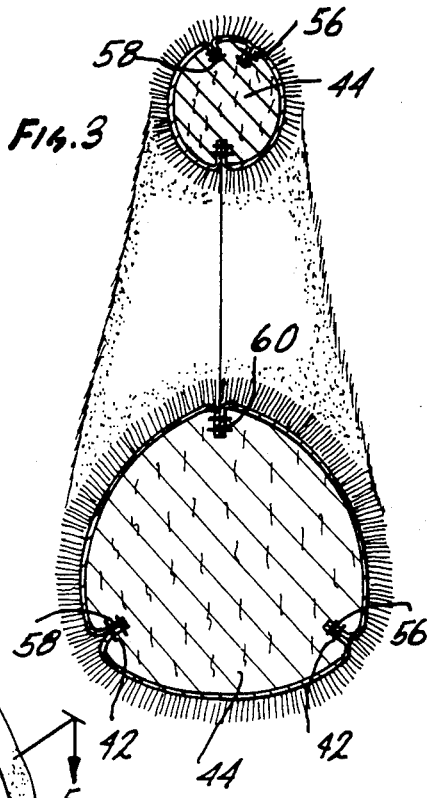
FIG. 3 is a cross-sectional view taken in the direction of arrows 3—3 shown in FIG. 2.
Figure 5:
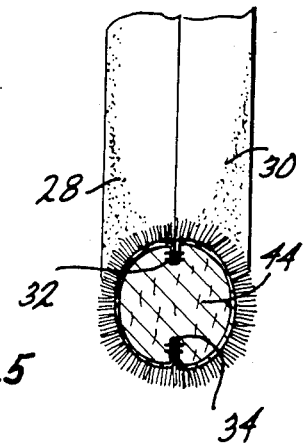
FIG. 5 is a cross-sectional view taken in the direction of arrows 5—5 shown in FIG. 4.

The appendage shown in FIG. 4 is fabricated by cutting covers 28 and 30 from a compliant material using a spiral-shaped pattern (see FIG. 9). The covers 28 and 30 are then secured together along seams 32 and 34 using any available method such as stitching, or the like. Typical stitches 42 are best shown in FIG. 3. Fill or stuffing material 44 is then placed inside the appendage formed by covers 28 and 30. Any type of fill material 44 may be used such as nylon, cotton, fiber fills, or the like which provides a soft appendage. The fill material 44 is preferably stuffed harder near positions 38 and 39 (see FIG. 9) of the tapered, spiral-shaped appendage for the reasons explained below.

After the covers 28 and 30 have been secured together and the appendage has been stuffed with fill material 44, the appendage provides form-retaining features due to its spiral shape and the seams 32 and 34 which furnish additional resiliency holding the appendage in its spiral shape. As such, the seams 32 and 34 act like a spring biasing or forcing the appendage to retain its original spiral shape. Stuffing the fill material 44 harder near positions 38 and 39 (see FIG. 9) also increases the resiliency of the appendage. Also the fill material 44 may be stuffed harder near position 36 if desired. As a result, after the appendages are stretched or deformed as illustrated by dashed lines in FIG. 1 and then released, they return to their original spriral shapes when released as indicated by arrows 46 without the necessity of using elastic bands, metal devices, or resilient material. The combination of using spiral-shaped covers, longitudinal seams and fill material stuffed harder near the ends of the tapered appendages furnishes desired resiliency for the soft, plush appendages.

FIGS. 6 through 8 show how different embodiments of the toy 10 may be suspended from a support 48 using the spiral-shaped, form-retaining appendages. Since the fill material 44 is stuffed harder near positions 38 and 39 (see FIG. 9), the spiral-shaped portion of the appendages may be easily secured to the support 48.

Figure 2:
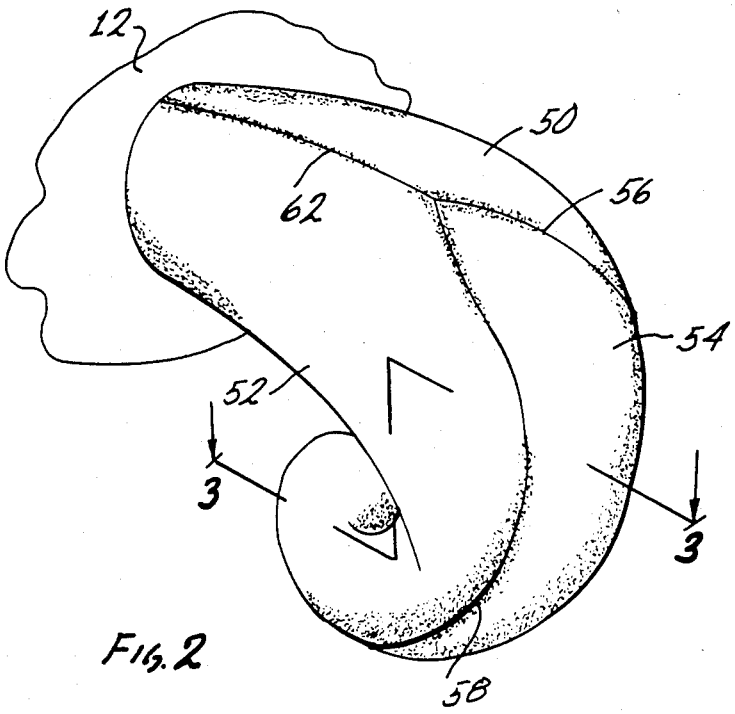
FIG. 2 is an enlarged perspective view of one embodiment of a spiral-shaped, form retaining appendage.

FIG. 2 shows another embodiment of the spiral-shaped, form-retaining appendages. The shown appendage has three outer covers 50 through 54 secured together at seams 56 through 62 forming a spiral-shaped appendage. The additional seams add increased resiliency to the appendage. Any desired number of seams or covers may be used for the appendages.

The above description discloses the preferred embodiments of the present invention. however, persons or ordinary skill in the toy field are capable of numerous modifications once taught these principles. Accordingly, it will be understood by those skilled in the art that changes in form and details may be made to the above-described embodiments without departing from the spirit and scope of the invention.

I claim:

1. A stuffed toy comprising:

a body portion; and at least one spiral-shaped appendage having a proximal end thereof attached to said body portion and a distal end thereof, said appendage including (a) at least two spiral-shaped outer covers of compliant material secured together by seams extending longitudinally along the length of said appendage, each of a first and second of said covers being a continuous piece of said compliant material having a spiral shape and a width which gradually diminishes in size along the longitudinal length thereof from a first position where said spiral shape starts to a second position near said distal end of said appendage, and (b) fill material stuffed inside said outer covers, said fill material being stuffed harder near said distal end of said appendage causing said fill material near said distal end to have a higher density than said fill material located away from said distal end, said appendage having a cross-section which gradually diminishes in size along said length of said appendage, reaching a minimum size near said distal end of said appendage, forming a tapered spiral-shaped appendage with a predetermined, tapered spiral shape, the inner periphery of said tapered spiral-shaped appendage having a radius which gradually decreases in size from said first position to said second position, said seams and said fill material, as stuffed, resiliently biasing said appendage into said predetermined, tapered spiral shape due to biasing forces generated solely by said seams and said fill material, as stuffed, said appendage capable of being deformed against the bias of said seams and said fill material, as stuffed, and capable of returning to said predetermined, tapered spiral shape under the bias of solely said seams and said fill material, as stuffed, after forces causing said deformation of said appendage are removed , said fill material stuffed harder near said distal end increasing the bias of said fill material in order to help return said appendage to said predetermined, tapered spiral shape after deformation thereof.

2. The stuffed toy of claim 1, wherein said outer covers are made of fabric material and stitched together along said seams.

3. A method of fabricating an appendage for a stuffed toy comprising the steps of:

cutting at least two outer covers from a complaint material using a spiral-shaped pattern so that each of said covers is a continuous piece of said compliant material having a spiral shape and a width which gradually diminishes in size along the longitudinal length thereof from a first position where said spiral shape starts to a second position near the free end of said appendage;

securing said outer covers together along longitudinally extending seams;

stuffing said secured outer covers with a fill material so that a tapered spiral-shaped appendage is formed and said fill material is stuffed harder near the free end of said appendage , the inner periphery of said tapered spiral-shaped appendage having a radius which gradually decreases in size from said first position to said second position; and attaching one end of said appendage to said stuffed toy, said seams used to secure said outer covers together and said fill material, as stuffed, resiliently biasing said appendage into said tapered spiral shape, said appendage capable of being deformed against the bias of said seams and said fill material and capable of returning to said tapered spiral shape under the bias of said seams and said fill material after forces causing deformation of said appendage are removed.

* * * * *